US007173568B2

(12) United States Patent
Kanazawa

(10) Patent No.: US 7,173,568 B2
(45) Date of Patent: Feb. 6, 2007

(54) ANTENNA DEVICE AND RADIO COMMUNICATION DEVICE

(75) Inventor: Masaru Kanazawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 132 days.

(21) Appl. No.: 11/089,838

(22) Filed: Mar. 24, 2005

(65) Prior Publication Data

US 2006/0125700 A1 Jun. 15, 2006

(30) Foreign Application Priority Data

Dec. 9, 2004 (JP) ..... 2004-357398

(51) Int. Cl.
*H01Q 1/24* (2006.01)

(52) U.S. Cl. ..... 343/702; 455/575.5; 455/575.7

(58) Field of Classification Search ..... 455/575.5, 455/575.7, 575.3, 575.1; 343/702, 818, 820, 343/841

See application file for complete search history.

(56) References Cited

U.S. PATENT DOCUMENTS

| | | | | |
|---|---|---|---|---|
| 6,246,374 | B1 * | 6/2001 | Perrotta et al. | 343/702 |
| 6,995,719 | B2 * | 2/2006 | Ide | 343/702 |
| 2003/0117324 | A1 * | 6/2003 | Iwai et al. | 343/702 |

FOREIGN PATENT DOCUMENTS

| | | |
|---|---|---|
| JP | 10-084406 | 3/1998 |

* cited by examiner

*Primary Examiner*—Hoang V. Nguyen
*Assistant Examiner*—Ephrem Alemu
(74) *Attorney, Agent, or Firm*—Katten Muchin Rosenman LLP

(57) ABSTRACT

The present invention relates to an antenna device disposed in a case and prevents antenna characteristics from being degraded by a human body. The antenna device is configured such that it comprises an antenna that is disposed in a first case unit, a passive element that is disposed in a second case unit coupled to the first case unit and that can obtain an antenna function due to capacitive coupling with the antenna, and a conductor (printed board) that is disposed in the second case unit to suppress radiations from the passive element to one side of the second case unit.

18 Claims, 18 Drawing Sheets

Range (-40;0) [dBd]
Scale 10[dB]/div.

FIG.12

| | QUANTITY OF IMPROVEMENT |
|---|---|
| QUANTITY OF INFLUENCE BY A HUMAN BODY | 3.3dB |
| S A R | 59.3% |

ANTENNA DEVICE AND RADIO COMMUNICATION DEVICE

This application claims the benefit of priority from prior Japanese Patent Application No. 2004-357398.

BACKGROUND OF THE INVENTION

1. Field of the Invention

The present invention relates to an antenna device used in various radio communication devices such as a cellular phone having a case with folding structure, turning structure, sliding structure or the like and, for example, to an antenna device and a radio communication device of which radiation patterns can be switched by an opening or closing operation of the case unit.

2. Description of the Related Art

For an antenna used in various radio communication devices such as a cellular phone, radiation efficiency is used to evaluate a property of the antenna. Since the radiation efficiency varies by a distance between the antenna and a ground conductor, a matching circuit or the like, improvement in the antenna characteristics is relatively easy by adjusting the radiation efficiency, however, for the radio communication device used in close proximity to a human body, it is known that the radiation pattern is affected by the human body.

Conventionally, for a radio communication device with folding structure, Japanese Patent Application Laid-Open Publication No. 1998-84406, for example, discloses one equipped with a conductor that is a passive element, along with an antenna. This has been proposed in order to improve significant degradation of the antenna characteristics when the case is folded. By providing a first case and a second case, an antenna disposed in the first case is positioned between the first and second cases when the first and second cases are folded, and a passive element disposed in the second case is arranged in parallel with the antenna when the first and second cases are folded. By electrically relating the antenna to the passive element when the first and second cases are folded, the passive element acts as an antenna and thus a configuration of two-element antenna is employed.

By the way, in the radio communication device such as a cellular phone, even if the configuration to operate as two-element antenna (Japanese Patent Application Laid-Open Publication No. 1998-84406) improves the antenna characteristics in a folded state, the antenna characteristics are not improved when the first and second cases are in an open state and, in the situation that the device is used in close contact with the head of a human body, radiation pattern is affected by the human body.

Japanese Patent Application Laid-Open Publication No. 1998-84406 does not disclose these problems nor a configuration and suggestion for resolving the problems exists.

SUMMARY OF THE INVENTION

The present invention relates to an antenna device disposed in a case, and a first object thereof is to prevent the antenna characteristics from being degraded by a human body.

Also, the present invention relates to an antenna device built into a case, and a second object is to change a radiation pattern through operations such as an opening or closing, turning and sliding of the case.

In order to achieve the above objects, according to an aspect of the present invention, there is provided an antenna device comprising an antenna that is disposed in a first case unit; a passive element that is disposed in a second case unit coupled to the first case unit, the passive element acquiring an antenna function due to capacitive coupling with the antenna; and a conductor that is disposed in the second case unit to suppress radiations from the passive element to one side of the second case unit.

In this configuration, the first case unit and the second case unit are configured to be coupled together. The antenna disposed in the first case unit is used for transmitting and receiving radio signals. The passive element disposed in the second case unit acts as an antenna due to capacitive coupling with the antenna on the first case unit side. In contrast to the radiation pattern only by the antenna, since the passive element has the antenna function, so that radiation can be obtained from the passive element and the radiation pattern thereof is transformed by overlapping with the radiation pattern of the antenna. For the radiation from the passive element, the radiation to the one side of the second case unit is suppressed by the conductor disposed in the second case unit. Therefore, the radiation from the passive element can be obtained; the antenna characteristics are improved by suppressing the radiation with the conductor; and the effects of the human body can be reduced on the radiation property.

To attain the above objects, the passive element may be configured to pass electric current due to capacitive coupling with the antenna. According to this configuration, since the electric current passes through the passive element due to capacitive coupling with the antenna, the electric current is prevented from concentrating on the antenna side. The radiation pattern is also formed on the passive element side. As a result, the effects of the human body on the radiation pattern can be reduced on the first case unit side held by the hand.

To attain the above objects, the passive element may be configured to acquire capacitive coupling with the antenna by being approached by an end of the antenna. According to this configuration, since capacitive coupling can be achieved in a portion with a high voltage distribution and a low current distribution, the electric coupling becomes dense between the antenna and the passive element.

To attain the above objects, the conductor may be configured to act as a reflecting portion for radiations from the passive element. According to this configuration, since the conductor acts as a reflecting portion for the passive element, the radiation from the passive element can be increased and the radiation to the human body side can be suppressed as well.

To attain the above objects, the conductor may be configured as a substrate disposed in the second case unit; the passive element may be disposed in the back side of the second case unit, with the conductor disposed in the front side of the second case unit; capacitive coupling between the passive element and the antenna may be switched depending on positions of the first case unit and the second case unit; a distance between the passive element and an end of the antenna may be varied in order for capacitive coupling between the passive element and the antenna to be switched, depending on positions thereof; and the passive element may have a length of one half of a wavelength of the radiated electric wave, or a length approximate thereto.

In order to achieve the above objects, according to another aspect of the present invention there is provided a radio communication device having a first case unit and a second case unit, the radio communication device comprising an antenna that is disposed in the first case unit; a passive element that is disposed in the second case unit coupled to the first case unit, the passive element acquiring an antenna function due to capacitive coupling with the antenna; and a conductor that is disposed in the second case unit to suppress radiations from the passive element to one side of the second case unit.

This configuration constitutes the radio communication device equipped with the above mentioned antenna device. In the radio communication device equipped with the antenna device provided with the functions as mentioned above: the radiation pattern is also formed on the passive element side; the electric current is prevented from concentrating on the first case unit side; and, by suppressing the radiation to the one side of the second case unit side, the effects of the human body on the radiation pattern can be avoided to improve the antenna properties such as the radiation efficiency, and therefore, the communication quality of the radio communication can be improved.

To attain the above objects, in this radio communication device, the passive element may be configured to pass electric current due to capacitive coupling with the antenna; the passive element may be configured to acquire capacitive coupling with the antenna by being approached by an end of the antenna; the conductor may be configured to act as a reflecting portion for radiations from the passive element; the conductor may be configured as a substrate disposed in the second case unit; the passive element may be disposed in the back side of the second case unit, with the conductor may be disposed in the front side of the second case unit; capacitive coupling between the passive element and the antenna may be switched depending on positions of the first case unit and the second case unit; a distance between the passive element and an end of the antenna may be varied in order for capacitive coupling between the passive element and the antenna to be switched, depending on positions thereof; and the passive element may have a length of one half of a wavelength of the radiated electric wave, or a length approximate thereto.

As set forth hereinabove, the present invention relates to an antenna device used in various radio communication devices such as a cellular phone, can switch radiation patterns and disperse a current distribution as well due to, for example, operations of a case unit, can achieve excellent antenna properties while suppressing the effects of a human body on a radiation property and can improve communication quality by being mounted in the radio communication devices.

Features and advantages of the present invention are listed as follows.

(1) According to an antenna device of the present invention: a passive element has an antenna function due to capacitive coupling with an antenna; a radiation pattern is obtained by adding a radiation from the passive element; the electric current can be dispersed; effects of a human body on the radiation pattern can be suppressed; and the electromagnetic wave absorption rate (SAR: Specific Absorption Rate) can be reduced.

(2) According to a radio communication device of the present invention, since equipped with the above mentioned antenna device, the electric current can be dispersed, and since the antenna properties are improved by suppressing the effects of a human body on the radiation pattern, communication quality can be improved.

Other objects, features and advantages of the present invention will become more apparent with reference to the accompanying drawings and the embodiments.

BRIEF DESCRIPTION OF THE DRAWINGS

FIG. 12 shows effects in the case of disposing a passive element;

DETAILED DESCRIPTION OF THE PREFERRED EMBODIMENTS

<First Embodiment>

Figure 1:
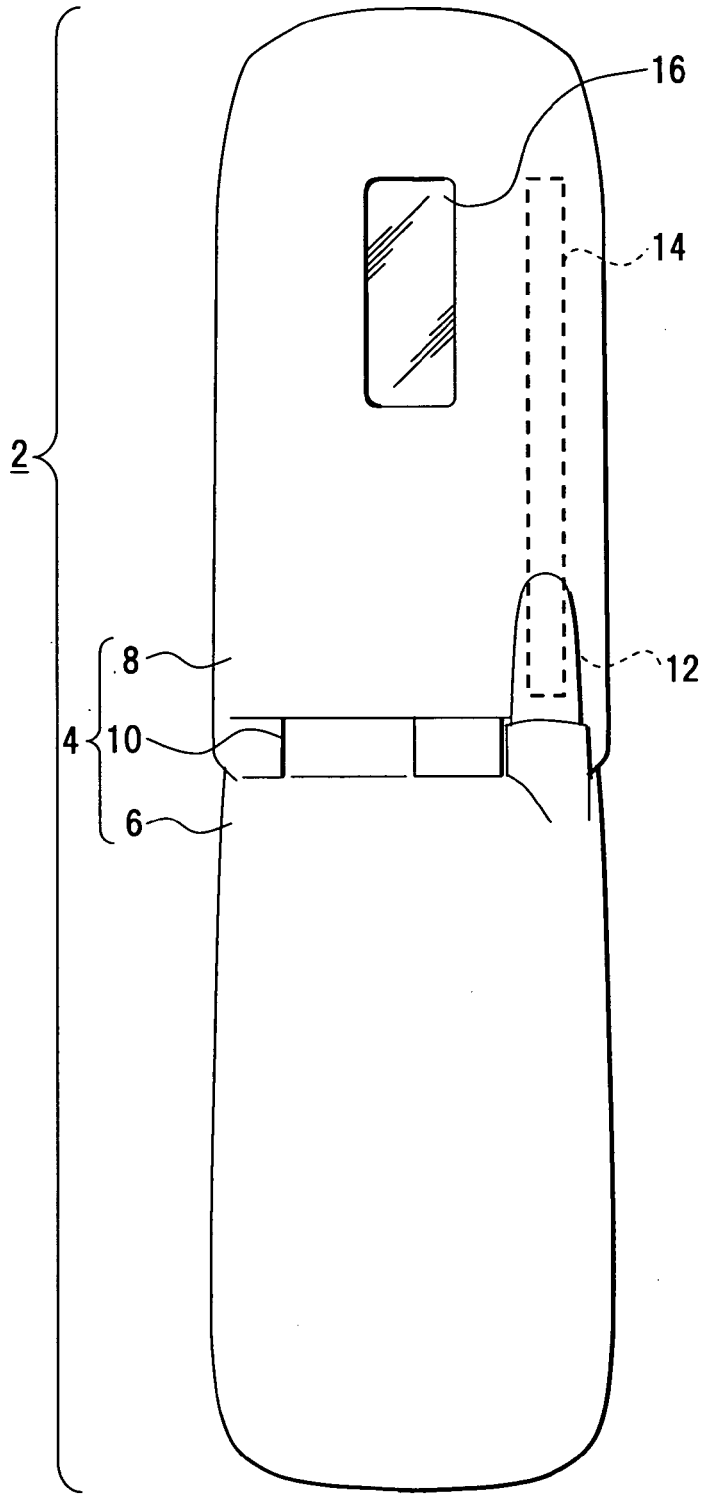
FIG. 1 shows a cellular phone according to a first embodiment of the present invention.
Figure 2:
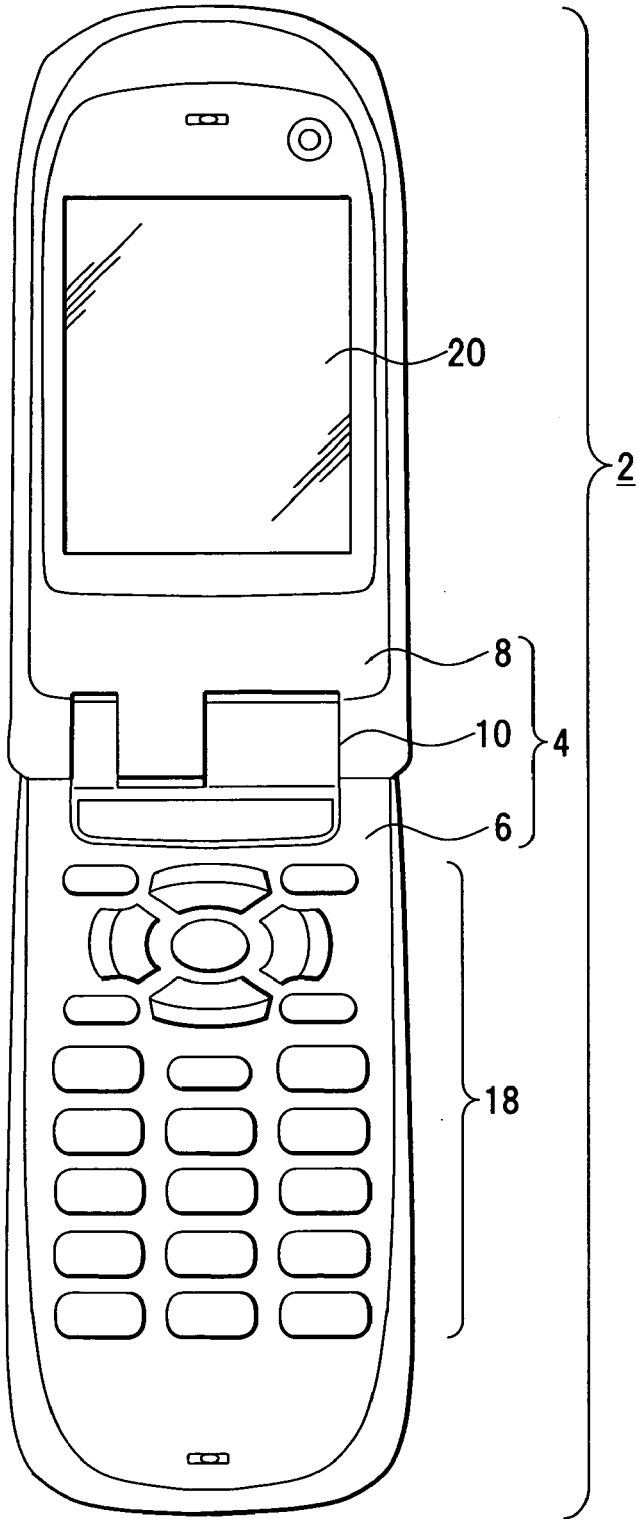
FIG. 2 shows a cellular phone opened and viewed from the front side.

For a first embodiment of an antenna device and a radio communication device of the present invention, descriptions are made with reference to FIG. 1 and FIG. 2. FIG. 1 shows a cellular phone opened and viewed from the backside, and FIG. 2 shows the cellular phone opened and viewed from the front side.

As an example of a radio communication device, the cellular phone 2 is provided with a case 4 having folding structure, and this case 4 is configured to be foldable at a hinge unit 10 by coupling a first case unit 6 with a second case unit 8 via the hinge unit 10. The case units 6 and 8 are made of insulating synthetic resin, for example. In this case, if the case unit 6 is a fixed portion, the case unit 8 becomes a moving portion, and if the case unit 8 is a fixed portion, the case unit 6 becomes a moving portion.

The case unit 6 is provided with an antenna 12, and a leading end of this antenna 12 protrudes to the side of the case unit 8 such that the leading end overlaps the back side of the opened case unit 8. Within the case unit 8, a band-like passive element 14 is mounted, avoiding a display element (LCD: Liquid Crystal Display) of a backside display unit 16. In the positional relationship between the passive element 14 and the antenna 12, the leading end of this antenna 12 is disposed to be overlapped with a portion of the passive element 14. In other words, with the openings of the case units 6 and 8, the overlapping positional relationship of the antenna 12 with the passive element 14 is maintained, and the antenna 12 and the passive element 14 are coupled by capacitive coupling. In other words, while the case units 6 and 8 are closed, an antenna device consists only of the antenna 12, and while the case units 6 and 8 are opened, since the passive element 14 has an antenna function by capacitive coupling between the antenna 12 and the passive element 14, an antenna device consisting of two-element, i.e., the antenna 12 and the passive element 14 is configured.

The antenna 12 is configured as a main antenna for the passive element 14 and may be configured with any antenna, for example, a linear antenna such as a whip antenna, helical antenna and monopole, a sheet metal antenna such as an inverted-F and inverted-L antenna, and a dielectric antenna disposing a conductor on dielectric. The passive element 14 may be any conductor, for example, a sheet metal, a conductive tape, an evaporated conductor or the like so long as conductive material.

The front side of the case unit 6 is provided with an input operation unit 18 consisting of multiple keys, and the front side of the case unit 8 is provided with a front-side display unit 20 and the like. The front-side display unit 20 consists of the above mentioned display element (LCD).

Figure 3:
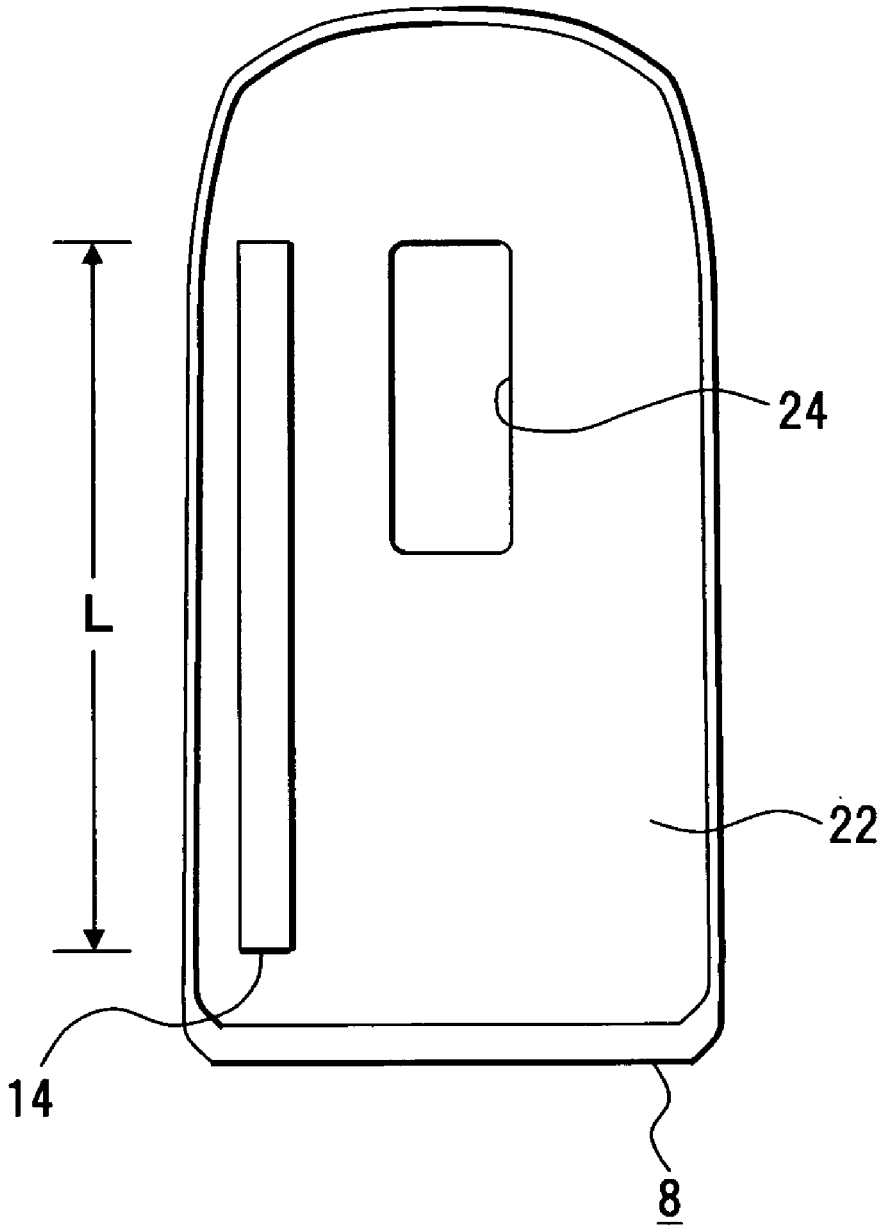
FIG. 3 shows an example of a configuration of a passive element.

Then, the passive element is described with reference to FIG. 3. FIG. 3 shows an example of a configuration of the passive element.

In this embodiment, the passive element 14 is disposed in an inner face portion of a backside case unit 22 of the case unit 8, and the passive element 14 is made of a band-like conductor. 24 denotes a display window portion of the backside display unit 16. A length L of the passive element 14 may be a length resonated by a radio signal, for example, a length of one half of a radio signal wavelength, or an approximate value thereof.

Figure 4:
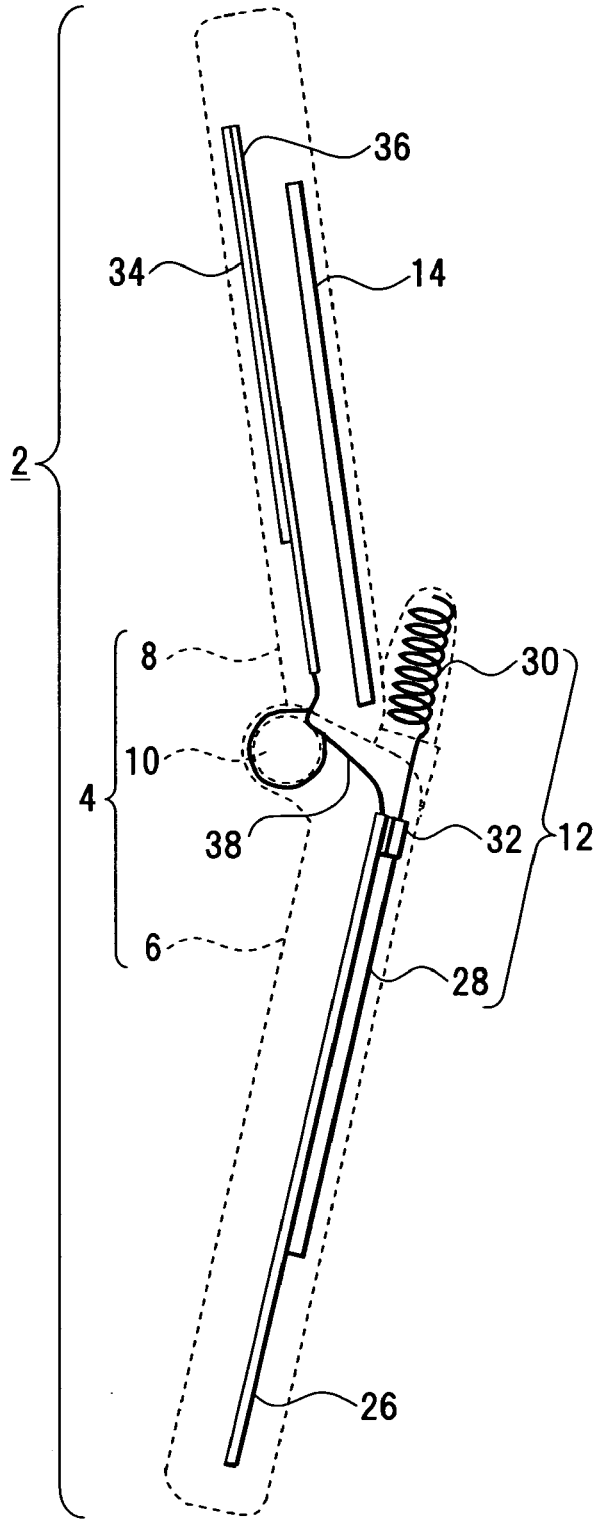
FIG. 4 shows an internal structure of a cellular phone in an open state.
Figure 5:
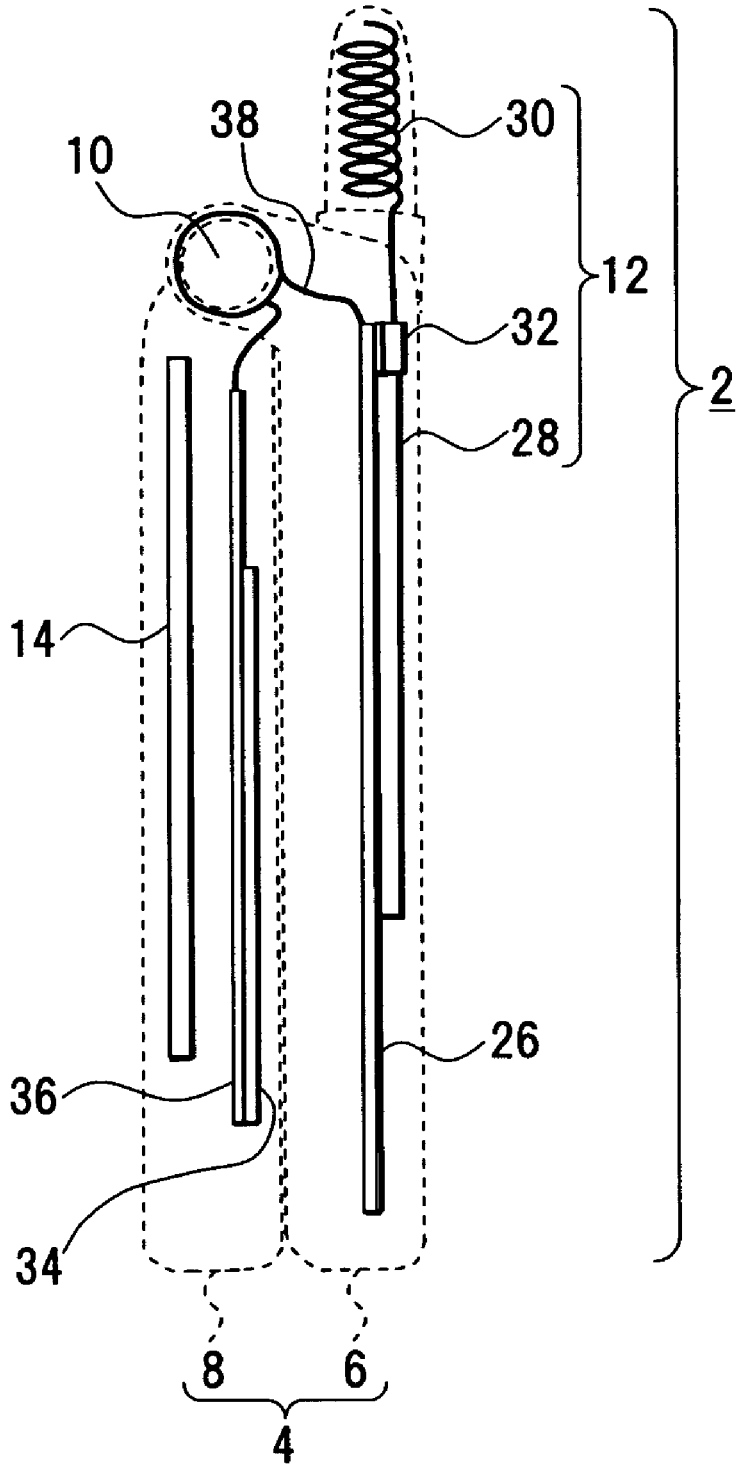
FIG. 5 shows an internal structure of a cellular phone in a closed state.

Then, an internal structure of a cellular phone is described with reference to FIG. 4 and FIG. 5. FIG. 4 shows an internal structure of a cellular phone in an open state, and FIG. 5 shows an internal structure of a cellular phone in a closed state.

The case unit 6 is equipped with, for example, a printed board 26 as a wiring member on which the input operation unit 18 and a transmission/reception unit or the like are mounted, and the antenna 12 adjacent to this printed board 26. The antenna 12 consists of a linear conductor portion 28 and a coil portion 30, and a feeding portion 32 is defined in between. The transmission/reception unit connected to the feeding portion 32 constitutes a signal source at the time of transmission of a radio signal.

The case unit 8 is equipped with, for example, a printed board 36 as a wiring member on which a display element 34 of the front display unit 20, and this printed board 36 is disposed so as to cover the front side of the passive element 14. Since this printed board 36 includes a wiring conductor and a ground conductor, this printed board 36 constitutes a conductor as a shielding member covering the front side of the passive element 14. The printed board 36 and the printed board 26 are electrically coupled via a wiring conductor disposed across the hinge unit 10, for example, a flexible substrate 38. The ground conductors of the printed boards 26 and 36 are set to be the same potential.

As shown in FIG. 4, in the state that the case units 6 and 8 are opened, the coil portion 30 of the antenna 12 is in close proximity to the passive element 14, therefore a state of capacitive coupling is brought about therebetween. As shown in FIG. 5, in the state that the case units 6 and 8 are closed (in the folded state), the coil portion 30 of the antenna 12 is away from the passive element 14, and the coil portion 30 and the passive element 14 are in a non-coupling state. Moreover, there are the printed boards 26 and 36 that may be considered as conductors between the passive element 14 and the antenna 12, which constitute a shielding member making the passive element 14 and the antenna 12 in a non-coupling state, and furthermore, the passive element 14 is not connected to the ground conductors of the transmission/reception unit or the printed boards 26 and 36. Therefore, in the folded state of the case units 6 and 8, the passive element 14 stays electrically irrelevant to the antenna 12 (in an electrically suspended state). Due to this configuration, the passive element can be considered as a dipole antenna having a feeding portion in the central portion.

Figure 6:
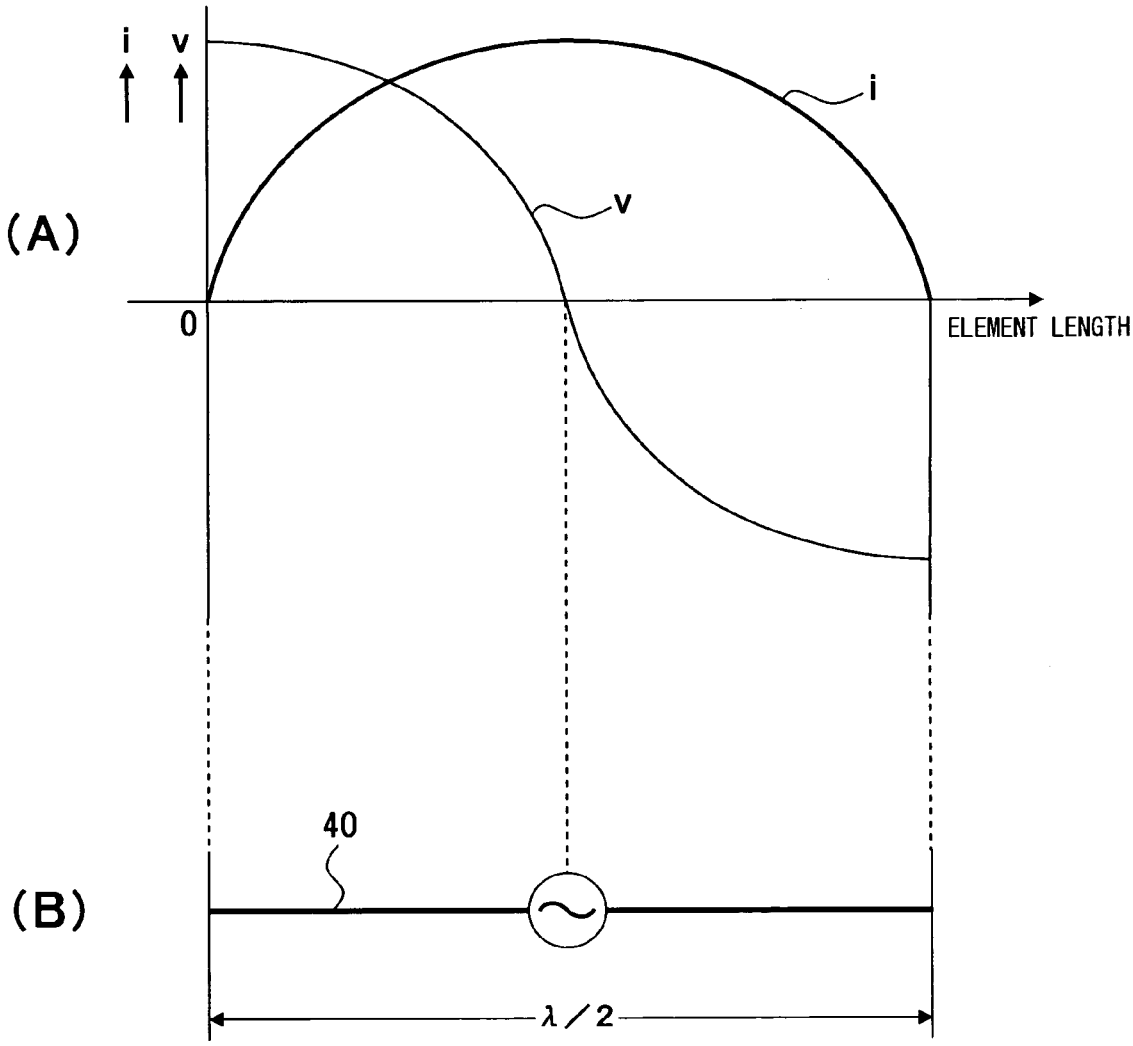
FIG. 6 shows performance of a dipole antenna.

The coupling relationship between the passive element 14 and the antenna 12 is described with reference to FIG. 6. FIG. 6 shows performance of a dipole antenna.

In FIG. 6, (A) shows a current distribution i and a voltage distribution v of the dipole antenna, and (B) shows power feeding of the dipole antenna. In the dipole antenna, the power feeding is generally performed by connecting a feeder cable to a central portion of an element having the maximum current distribution (i.e., the minimum impedance). Since phases difference between the current distribution i and the voltage distribution v is 90° ($\phi=\lambda/4$), an electric field E is minimized in the vicinity of the central portion of the element 40. The portion with the minimum electric field E has a condition that capacitive coupling is hardly obtained. On the other hand, at an end of the element 40, the electric field E is maximized. In other words, the end of the element 40 has a condition that capacitive coupling is obtained easily. Based on these principles, by positioning an end of the antenna 12 in close proximity to an end of the passive element 14 which can be considered as the dipole antenna, capacitive coupling can be easily obtained therebetween. Therefore, the mount position of the passive element 14 is preferred to be a position closest to the antenna 12 when the case 4 is opened, however, since capacitive coupling can be easily obtained between both due to the above mentioned conditions, the position may be any position where the passive element 14 can have an antenna function.

Figure 7A:
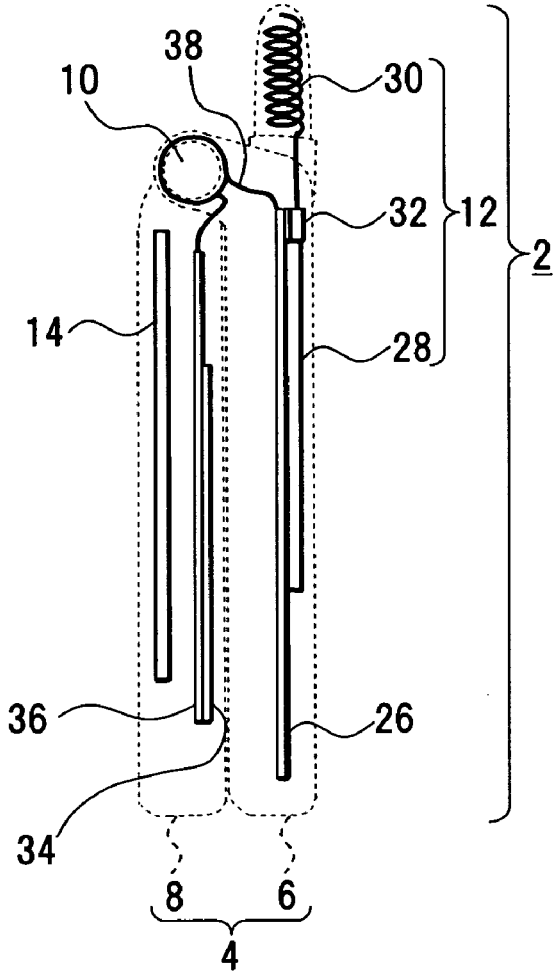
FIG. 7A and FIG. 7B show operations of an antenna while a case is in a closed state.
Figure 7B:
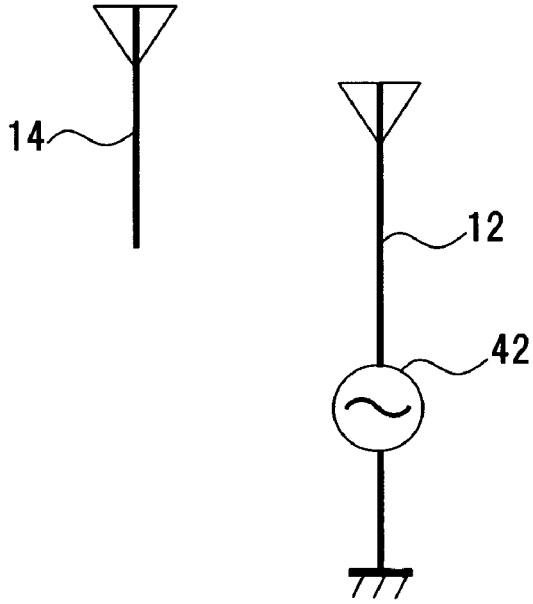

Then, operations of the dipole antenna are described with reference to FIG. 7A, FIG. 7B, FIG. 8A and FIG. 8B. FIG. 7A and FIG. 7B show operations of the antenna when the case is in the closed state, and FIG. 8A and FIG. 8B show operations of the antenna when the case is in the open state.

Even if the passive element 14 is mounted, as shown in FIG. 7, when the case unit 6 and 8 are folded, since the passive element 14 is electrically suspended as mentioned above and since the printed boards 26 and 36 exist that may be considered as conductors between the passive element 14 and the antenna 12, the passive element 14 becomes an irrelevant state to the antenna 12. In this case, the antenna device consists only of the antenna 12, as depicted by an equivalent circuit shown in FIG. 7B. 42 indicates the transmission/reception unit connected to the feeding portion 32 of the antenna 12.

Figure 8A:
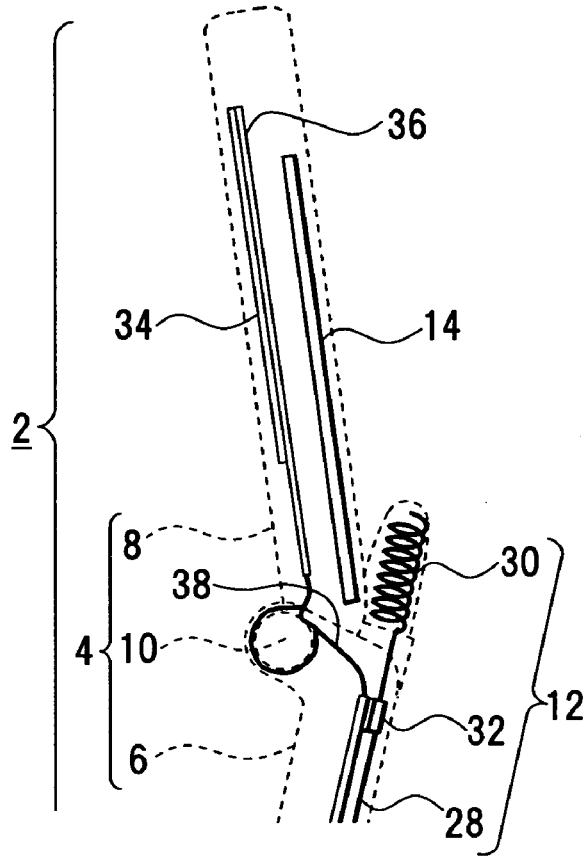
FIG. 8A and FIG. 8B show operations of an antenna while a case is in an open state.
Figure 8B:
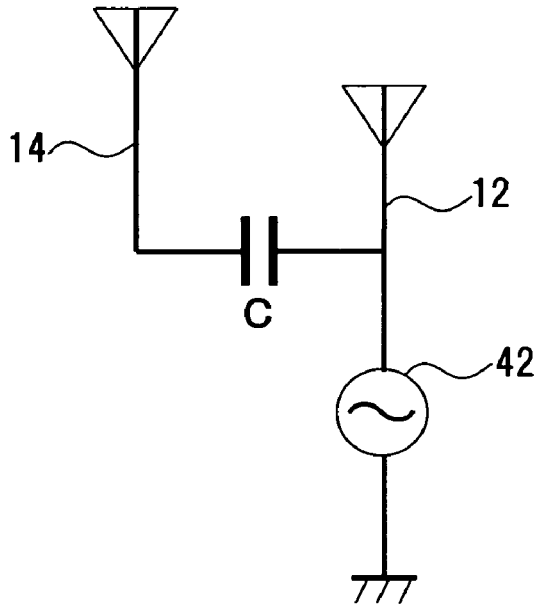

Also, as shown in FIG. 8A, when the case unit 6 and 8 are in the open state, the passive element 14 is in close proximity to a leading end of the antenna 12 and generates capacitive coupling with the antenna 12. In this case, as depicted by an equivalent circuit shown in FIG. 8B, a coupling via capacitance C, i.e., capacitive coupling can be obtained between the antenna 12 and the passive element 14. The capacitance C consists of a space between the coil portion 30 of the antenna 12 and the passive element 14 and, specifically, consists of dielectrics such as the material constituting the case unit 8, coating of the antenna and air.

Due to such capacitive coupling, although it may not be possible to transfer 100% of the energy from the antenna 12 to the passive element 14, most of the energy can be transferred to the passive element 14. As a result, the passive element 14 can obtain the antenna function, along with the antenna 12 that is in a capacitive coupling state.

Figure 9:
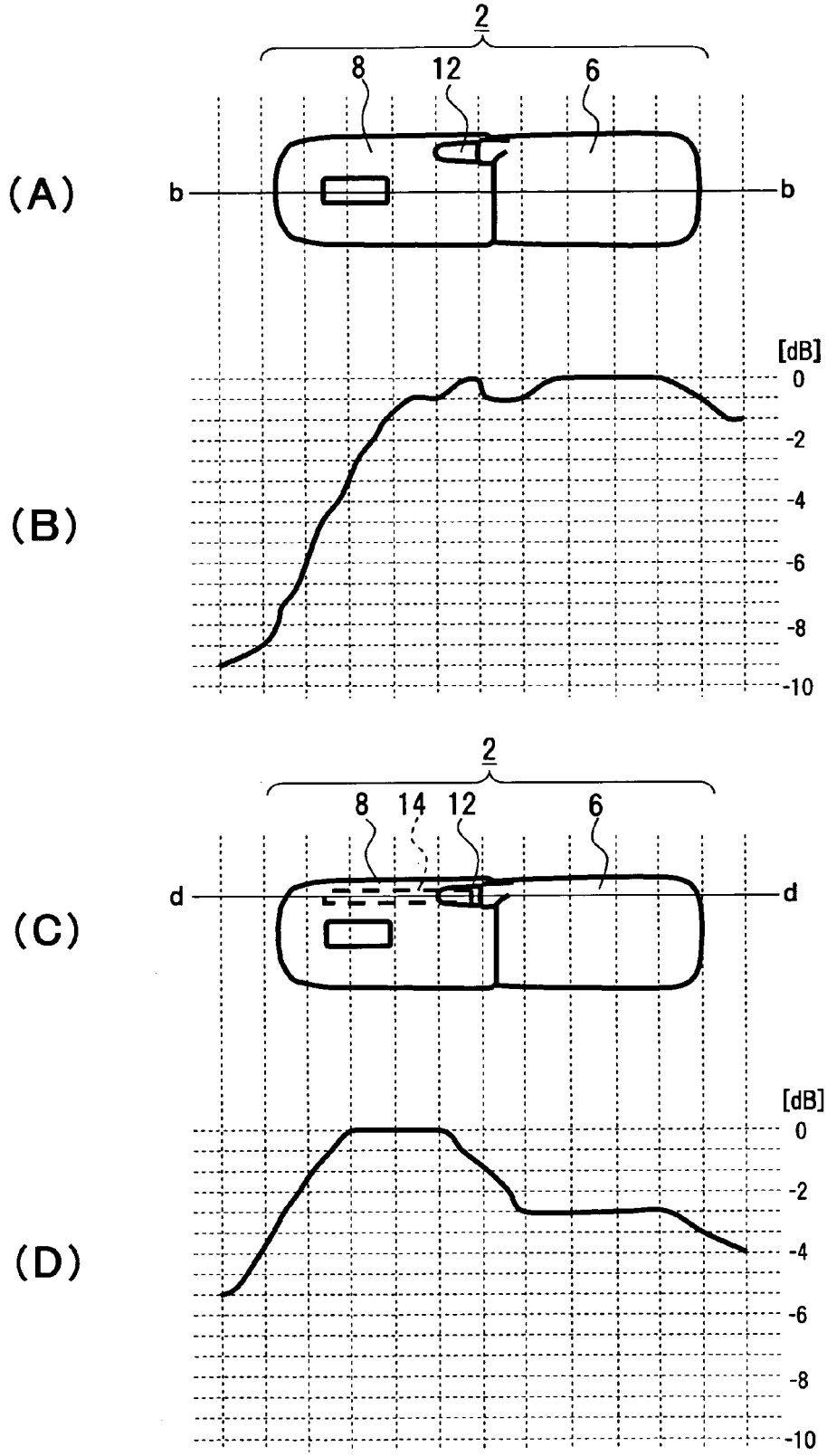
FIG. 9 shows current distributions with and without a passive element mounted.

Then, a current distribution in a cellular phone is described with reference to FIG. 9. FIG. 9 shows current distributions with and without a passive element mounted: (A) shows a cellular phone without the passive element mounted; (B) shows a current distribution in a b—b portion thereof; (C) shows a cellular phone with the passive element mounted; and (D) shows a current distribution in a d—d portion thereof.

Regarding to the cellular phone 2 without the passive element 14 mounted as shown in (A) of FIG. 9, the current distribution in the b—b portion is concentrated on the mounted portion of the antenna 12, as shown in (B) of FIG. 9. In other words, if the case unit 6 is gripped, the radiation efficiency and the electromagnetic wave absorption rate (SAR: Specific Absorption Rate) are significantly affected by a human body.

Regarding to the cellular phone 2 with the passive element 14 mounted as shown in (C) of FIG. 9, the current distribution in the d—d portion is dispersed in the mounted side of the passive element 14, as shown in (D) of FIG. 9. In other words, if the case unit 6 is gripped, the effect of a human body is reduced on the radiation efficiency and the electromagnetic wave absorption rate (SAR: Specific Absorption Rate).

Figure 10:
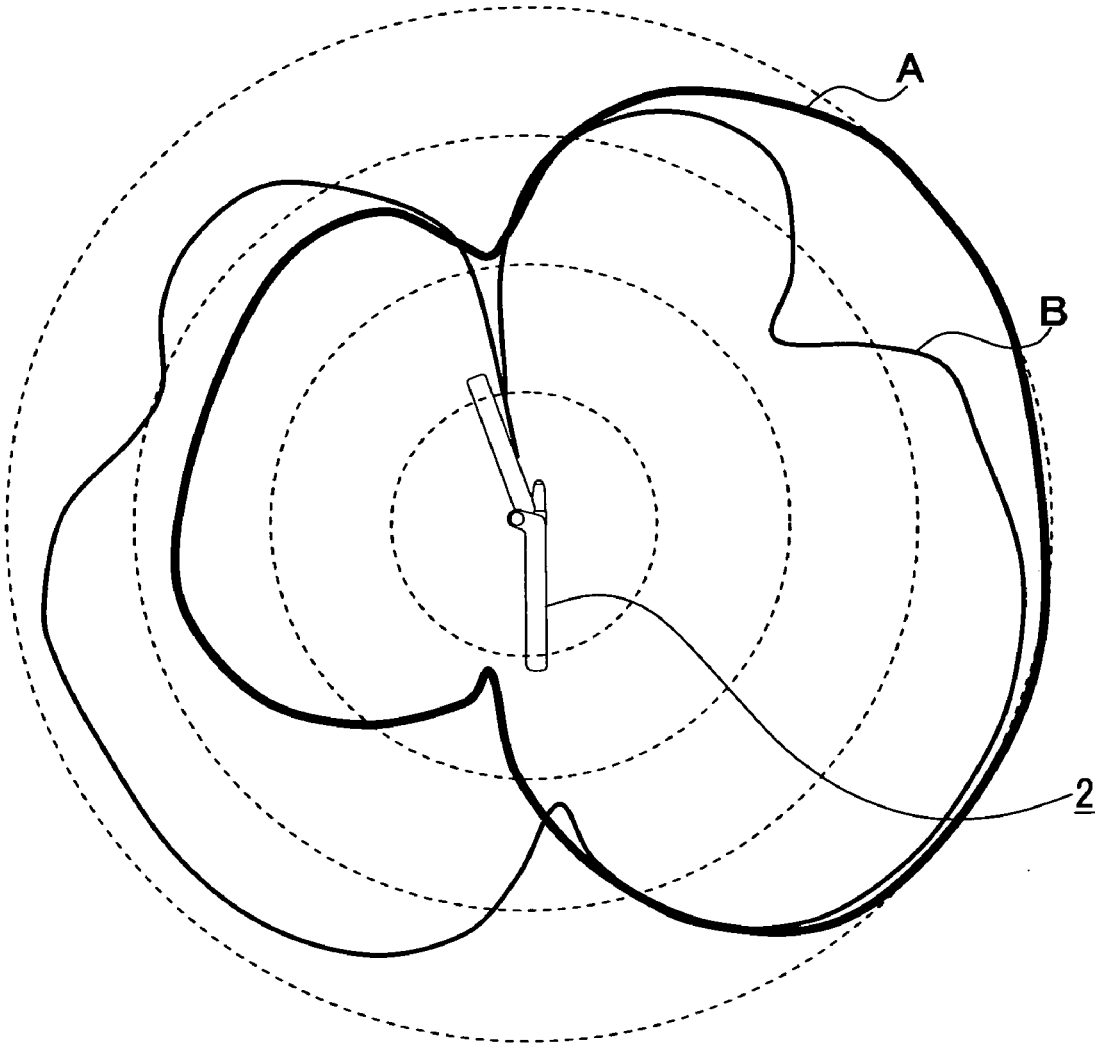
FIG. 10 shows radiation patterns with and without a passive element mounted.

Then, radiation patterns of the cellular phone are described with reference to FIG. 10. FIG. 10 shows radiation patterns with and without a passive element mounted. In FIG. 10, A indicates a radiation pattern in the case that the passive element 14 is mounted, and B indicates a radiation pattern in the case that the passive element 14 is not mounted.

In the case that the passive element 14 is mounted, compared to the case that the passive element 14 is not mounted, the radiation pattern swells on the case unit 8 side, and moreover, the shield function of the printed board 36 disposed in the case unit 8 works to suppress a front-side radiation as well as the printed board 36 functions as a reflecting portion to increase a backside radiation.

Figure 11:
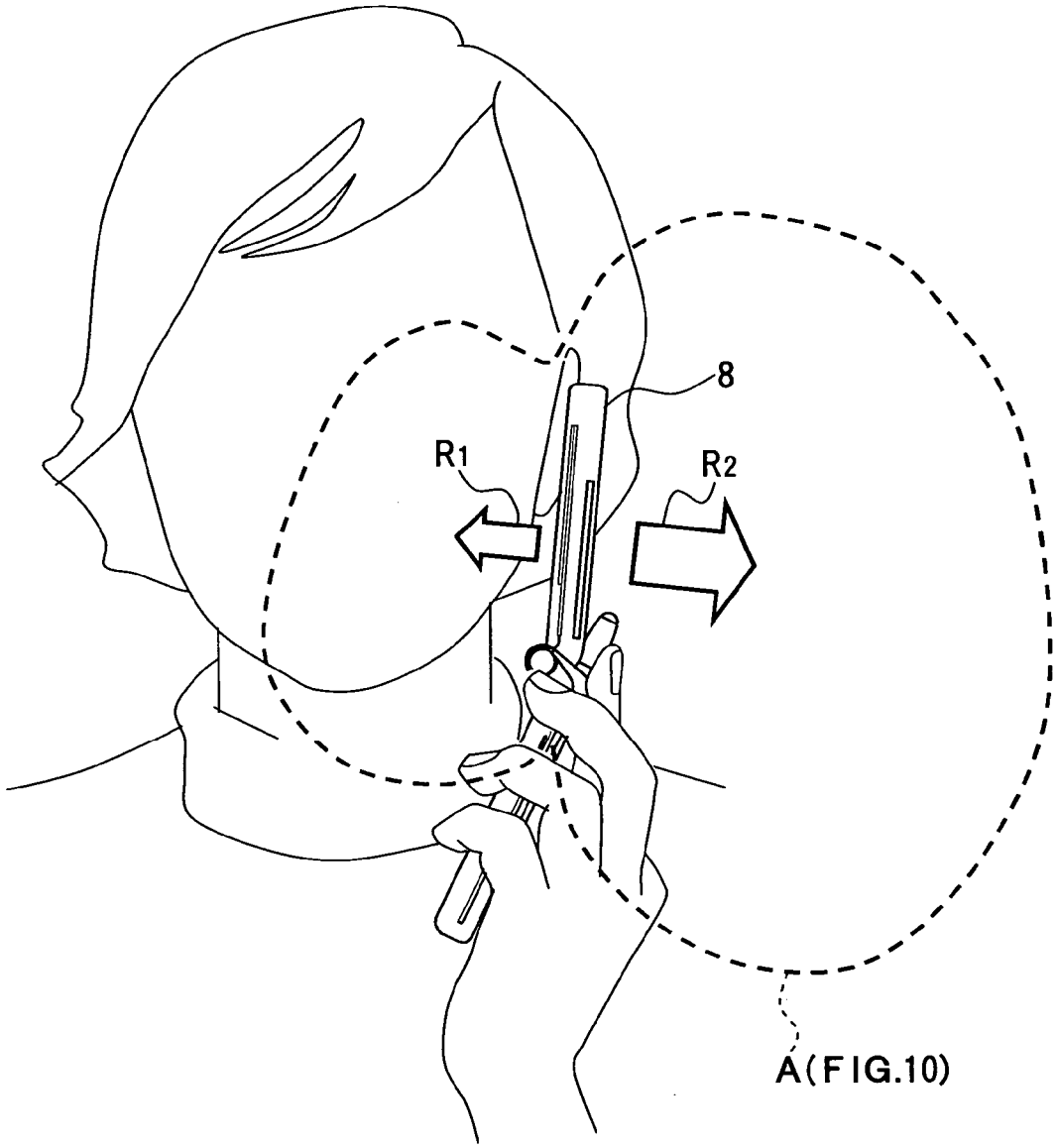
FIG. 11 shows a radiation pattern during a phone call.

Then, a relationship between the radiation pattern and a human body is described with reference to FIG. 11 and FIG. 12. FIG. 11 shows a radiation pattern during a phone call, and FIG. 12 shows effects in the case of disposing the passive element.

By overlapping the above mentioned radiation pattern (A of FIG. 10) with the cellular phone 2 during a phone call, as shown in FIG. 11, it will be understood that the radiation $R_1$ on the human body side is smaller and that the radiation $R_2$ in the opposite direction from the human body is larger. In this case, shield function and reflection function of the printed board 36 are of course working on the case unit 8 side, and furthermore, due to the dispersion of the electric current from the case unit 6 to the case unit 8, effects of the head of the human body on the radiation is reduced. Moreover, SAR will also be improved.

According to an experimental result, as shown in FIG. 12, improvements are significant in the case of mounting the passive element 14 and, as the effects of improvements, it is confirmed that a quantity of influence by a human body during a phone conversation is improved up about three (3) [db] and SAR is improved up to about 60 [%].

Also, in the radio communication devices such as the cellular phones equipped with these antenna devices, it is confirmed that the quality of the communication is enhanced and, for example, voices on the phone become clearer.

<Second Embodiment>

Figure 13:
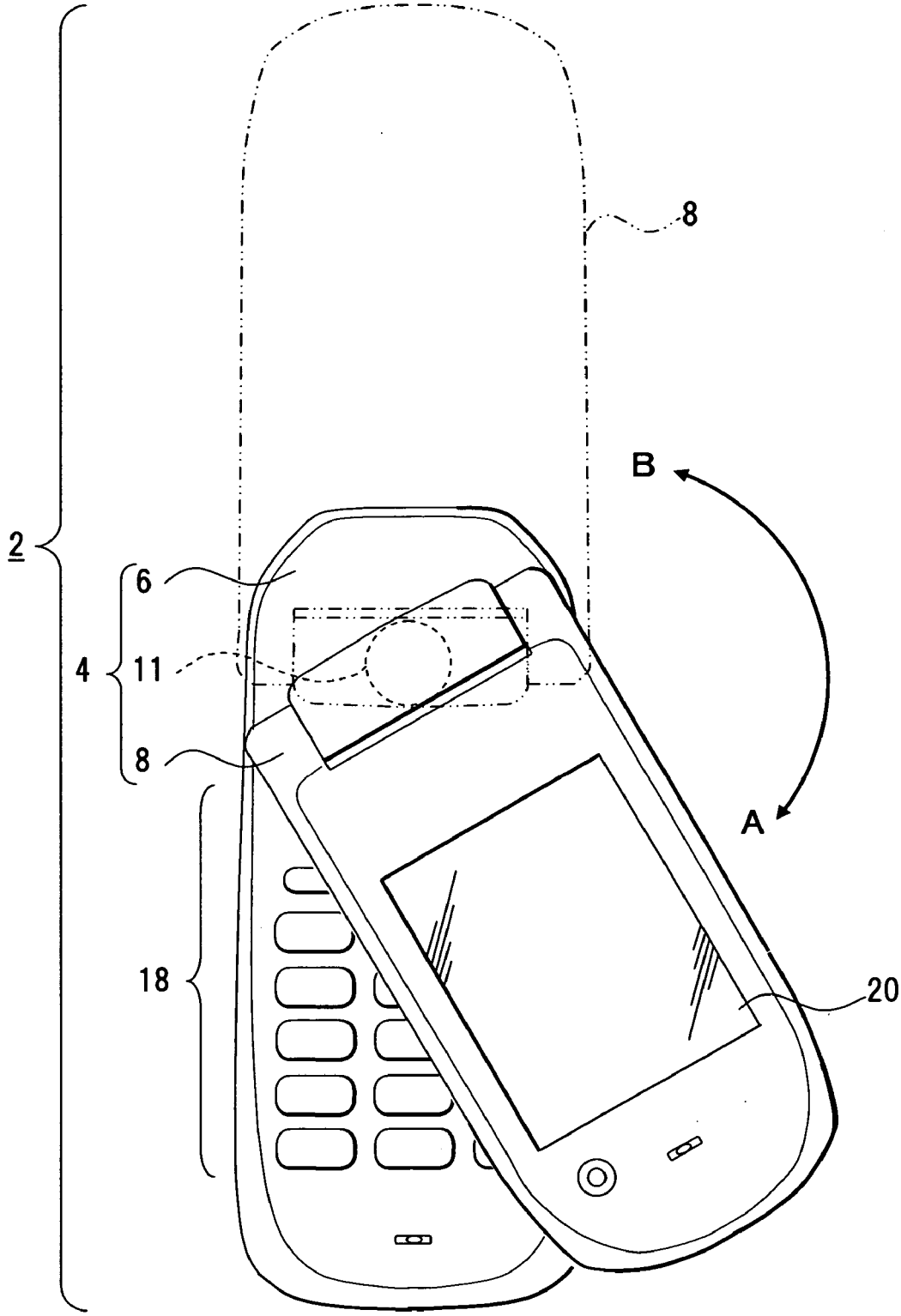
FIG. 13 shows a cellular phone according to a second embodiment of the present invention.
Figure 14:
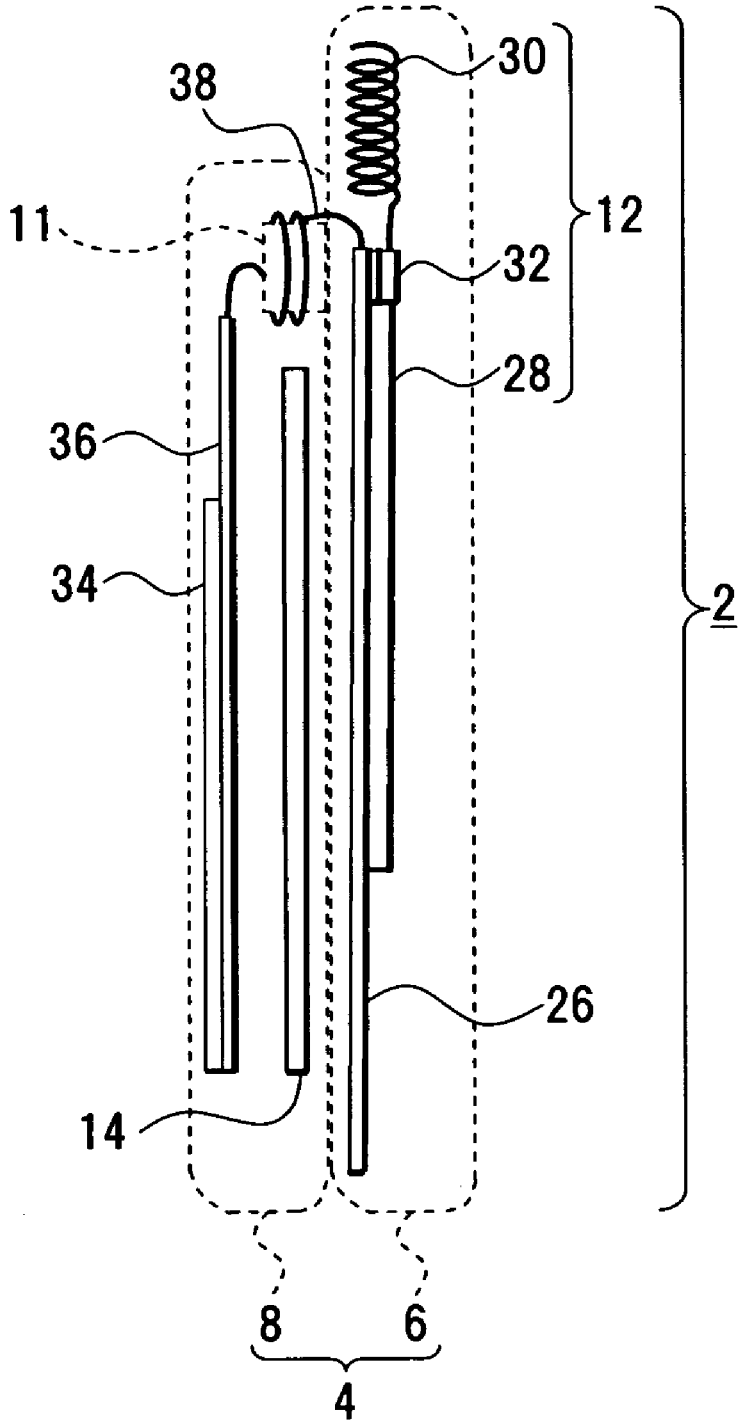
FIG. 14 shows an internal structure of a cellular phone before turning a case unit.
Figure 15:
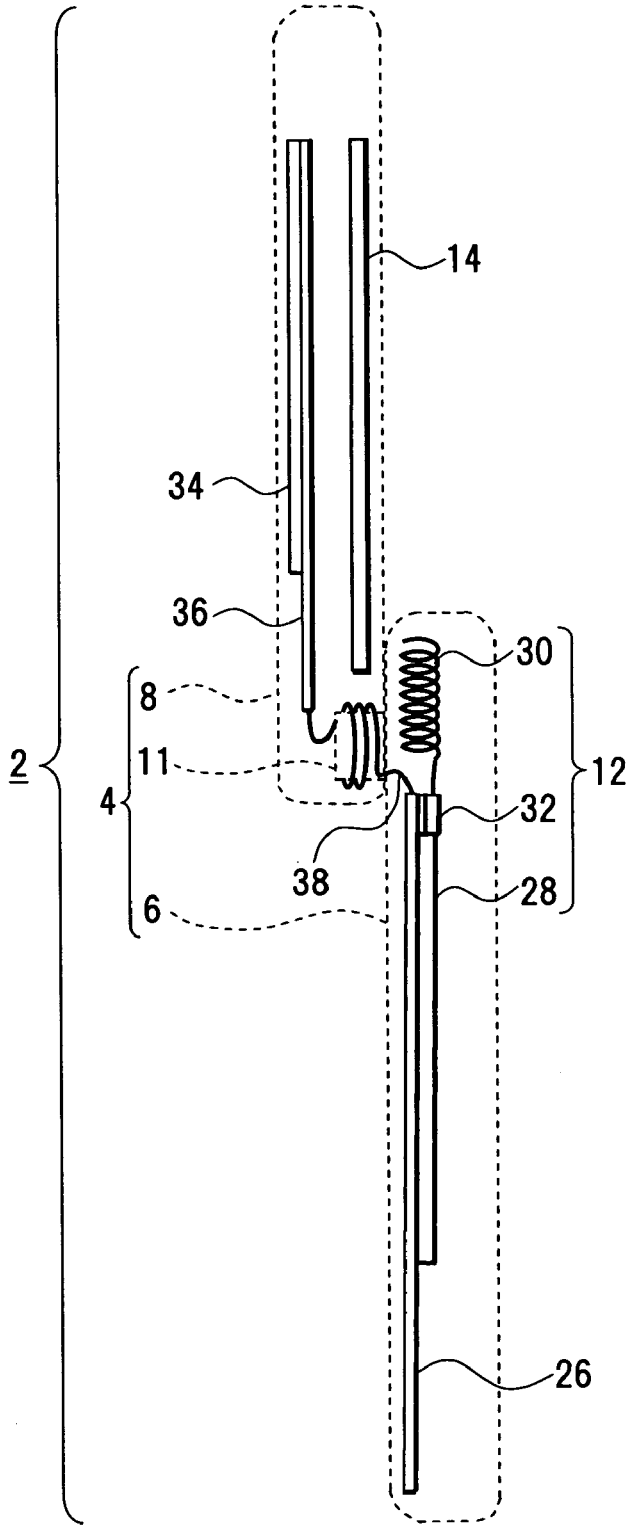
FIG. 15 shows an internal structure of a cellular phone after turning a case unit.

For a second embodiment of an antenna device and a radio communication device of the present invention, descriptions are made with reference to FIG. 13, FIG. 14 and FIG. 15. FIG. 13 shows a cellular phone having a case with turning structure in the middle of turning; FIG. 14 shows an internal structure before turning; and FIG. 15 shows an internal structure after turning. The cellular phone shown in FIG. 13 to FIG. 15, the same symbols are added to the same portions as the first embodiment.

The cellular phone 2 according to this embodiment is comprised of a case 4 with turning structure, and this case 4 is comprised of a first case unit 6 and a second case unit 8 and formed by coupling the case unit 6 and the case unit 8 via a supporting axis 11 to be pivotable. As shown by arrows A and B of FIG. 13, for example, by rotating the case unit 8 within the angular range of 180 degrees from a state that the case unit 8 is overlapped with the case unit 6, the case unit 8 is extended from the case unit 6, and this is the same form as the cellular phone 2 shown in FIG. 2.

In such a cellular phone 2 as having the case 4 with turning structure, if an antenna 12 is built into the case unit 6 side and the passive element 14 and the printed board 36 are disposed in the case unit 8 side, as shown in FIG. 14, the coil portion 30 of the antenna 12 is away from the passive element 14 in the state before turning, and a non-coupling state is brought about therebetween. In this case, the printed boards 26 and 36 are connected via a flexible substrate 38, and the ground conductors thereof are maintained in the same potential. Therefore, the passive element 14 is shielded by the printed boards 26 and 36. When the case unit 8 is rotated to be extended from the case unit 6, as shown in FIG. 15, the coil portion 30 of the antenna 12 comes close to the passive element 14, and a state of capacitive coupling is brought about therebetween. This state is the same as the first embodiment. In this way, the same effects as the first embodiment can be obtained from the cellular phone 2 having the case 4 with turning structure.

<Third Embodiment>

Figure 16:
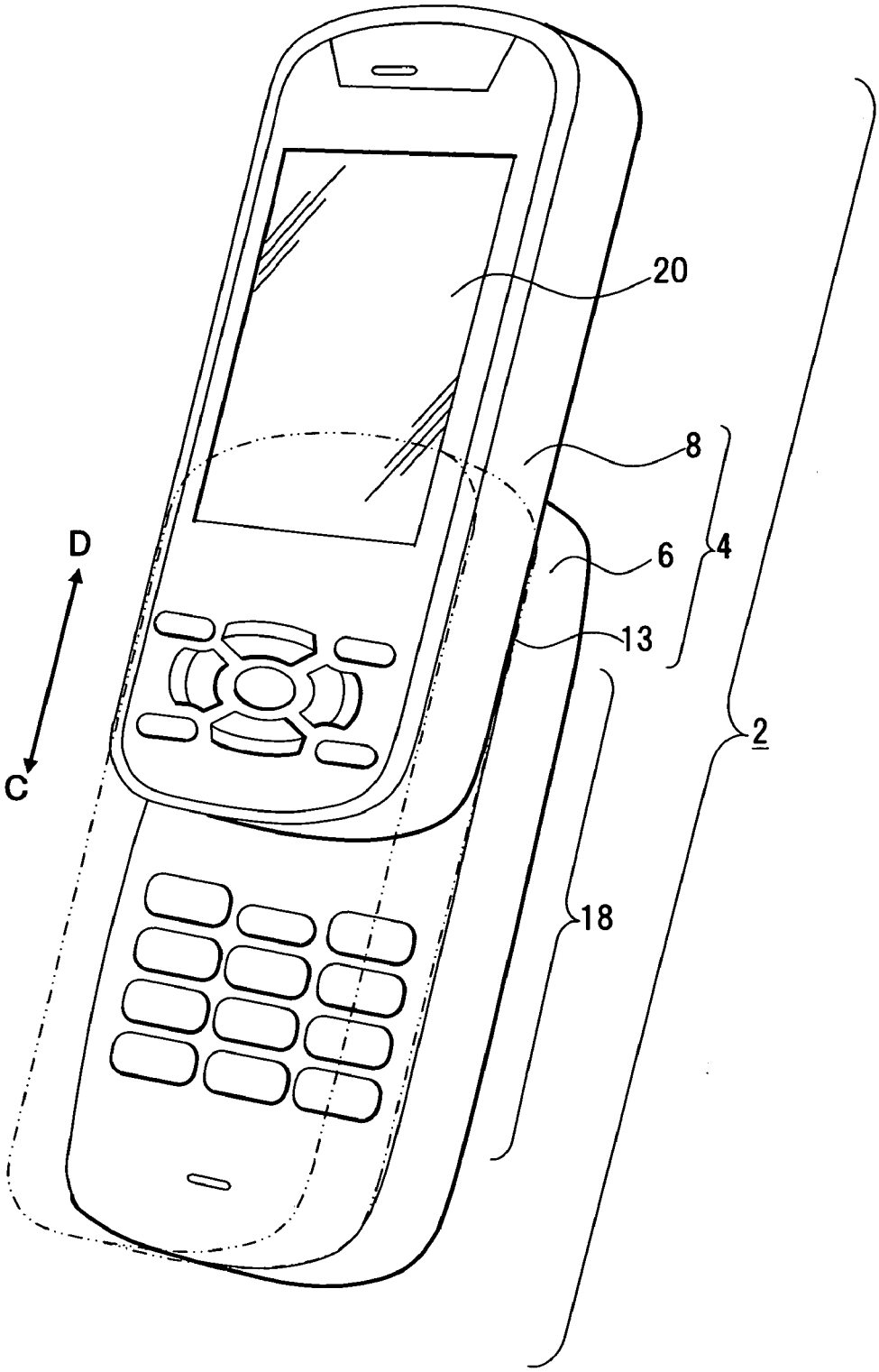
FIG. 16 shows a cellular phone according to a third embodiment of the present invention.
Figure 17:
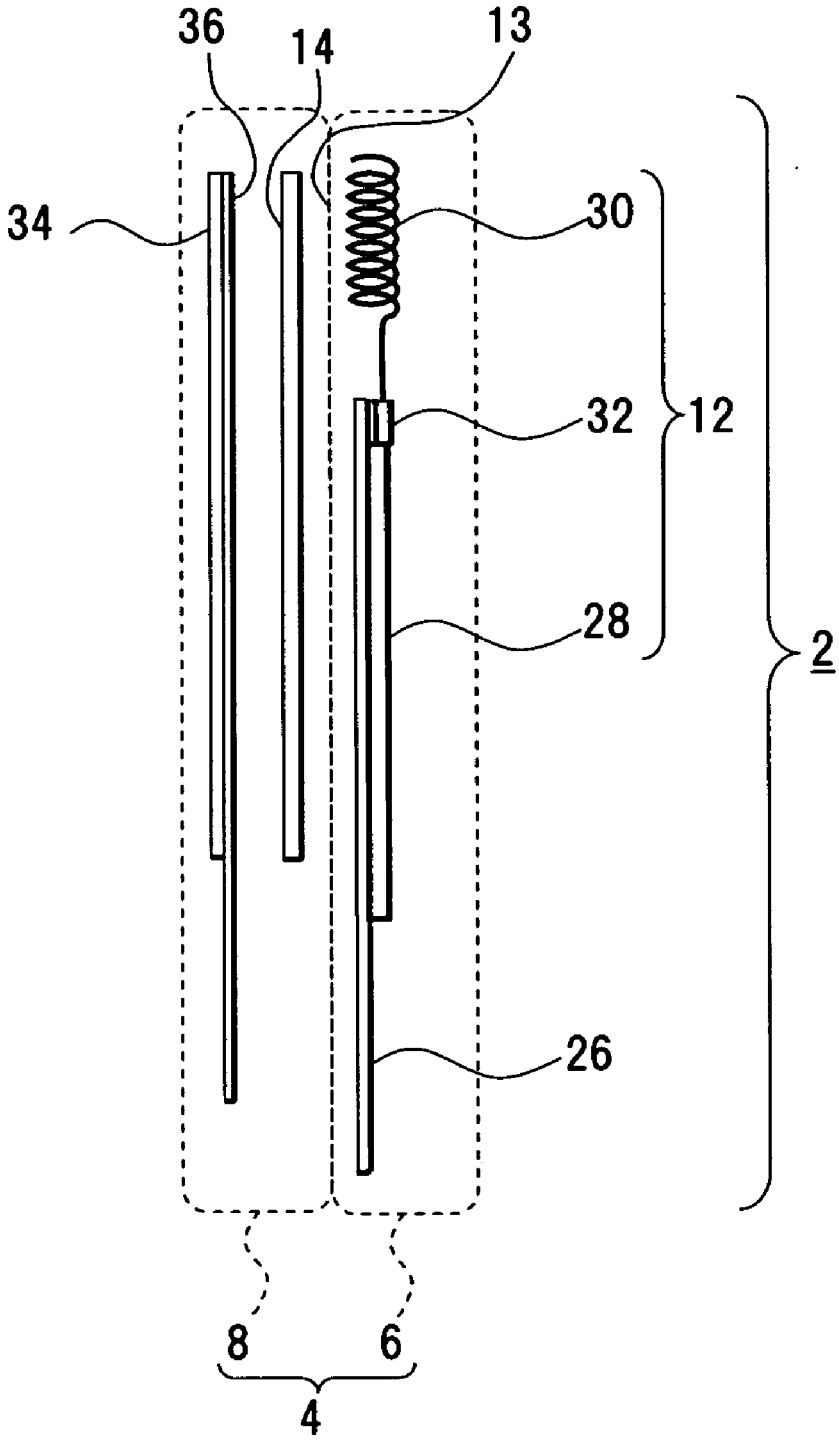
FIG. 17 shows an internal structure of a cellular phone before sliding a case unit.
Figure 18:
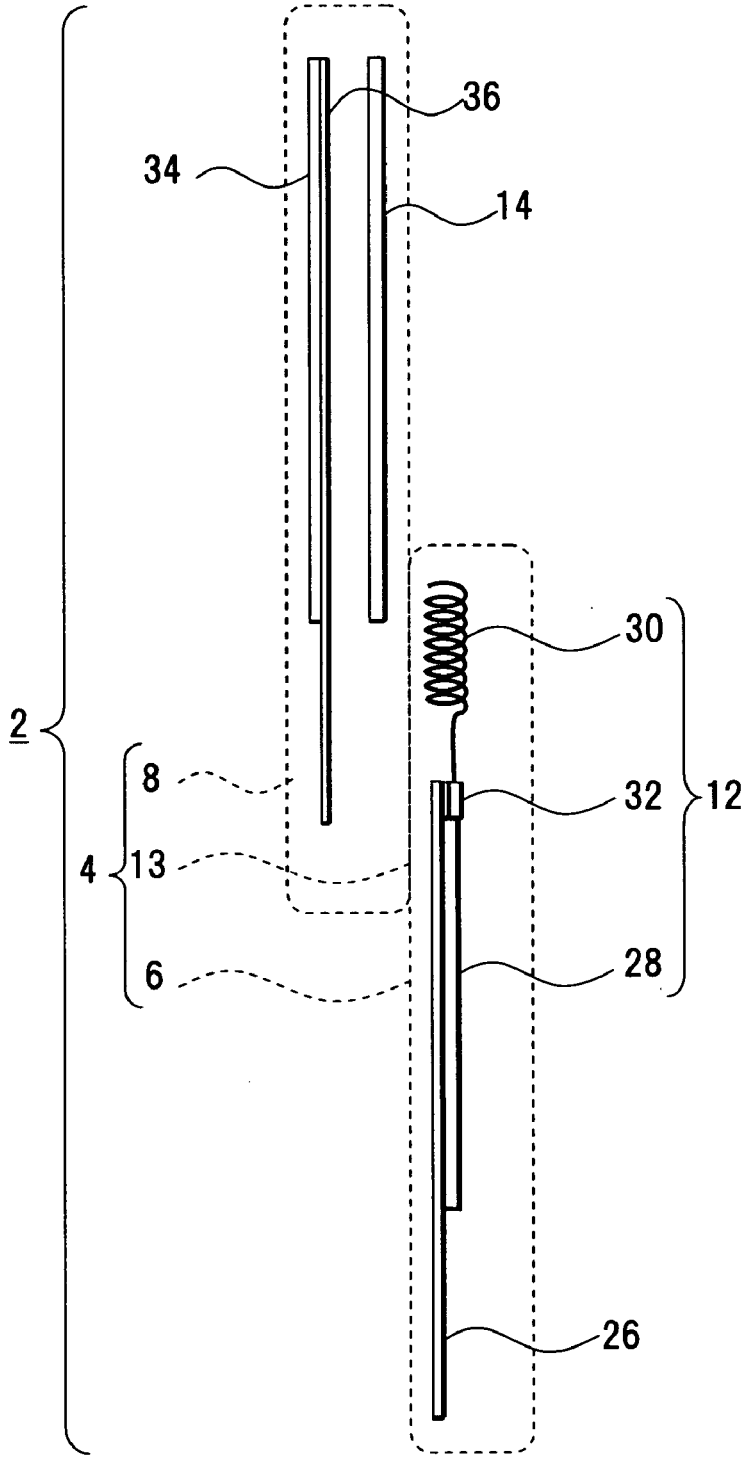
FIG. 18 shows an internal structure of a cellular phone after sliding a case unit

For a third embodiment of an antenna device and a radio communication device of the present invention, descriptions are made with reference to FIG. 16, FIG. 17 and FIG. 18. FIG. 16 shows a cellular phone having a case with sliding structure in the middle of sliding; FIG. 17 shows an internal structure before sliding; and FIG. 18 shows an internal structure after sliding. The cellular phone shown in FIG. 16 to FIG. 18, the same symbols are added to the same portions as the first embodiment.

The cellular phone 2 according to this embodiment is comprised of a case 4 with sliding structure, and this case 4 is formed by coupling the case unit 6 and the case unit 8 via a slide supporting portion 13 to be able to slide. As shown by arrows C and D of FIG. 16, by sliding the case unit 8 on the case unit 6 from a state that the case unit 8 overlaps with the case unit 6 as shown by a chain double-dashed line, the case unit 8 is extended from the case unit 6, and this is the same form as the cellular phone 2 shown in FIG. 2.

In such a cellular phone 2 as having the case 4 with sliding structure, if an antenna 12 is built into the case unit 6 side and the passive element 14 and the printed board 36 are disposed in the case unit 8 side, although the coil portion 30 of the antenna 12 is in proximity to the passive element 14 in the state before sliding as shown in FIG. 17, since the passive element 14 is sandwiched and shielded by the printed boards 26 and 36, the passive element 14 and the antenna 12 are in a non-coupling state. In this case, although not shown, since the printed boards 26 and 36 are connected via the flexible substrate or the like and each ground conductor is maintained in the same potential, the passive element 14 is shielded in the case 4 before sliding. When the case unit 8 is slid to be extended from the case unit 6, as shown in FIG. 18, the coil portion 30 of the antenna 12 comes close to the passive element 14, and the coil portion 30 and the passive element 14 enter a state of capacitive coupling. In this case, similar to the first embodiment, the passive element 14 is freed from the shield. In this way, the same effects as the first embodiment can be obtained from the cellular phone 2 having the case 4 with sliding structure.

It is noted that, by combining the folding structure according to the first embodiment with the turning structure according to the second embodiment, the case 4 can employ such a construction that a face portion of the case unit 8 is turned and folded to be inverted, overlapping the case unit 6. In such a cellular phone 2 having the case 4 with turning and sliding structure, the same effects as the first to third embodiments can be obtained, and the present invention is not limited to the structures of the case 4.

For the above described embodiments, characteristics and variations are listed as follows.

(1) Although the cellular phone is exemplified in the above embodiments, the present invention can be applied to various radio communication devices such as a personal digital assistant (PDA), a radio receiver, a personal computer with a radio communication function and a game machine with a radio communication function and the present invention is not limited to the cellular phones of the embodiments.

(2) Although the leading edge of the antenna 12 is protruded from the case unit 6 in the above embodiments, an antenna whose leading edge is not protruded may be used.

(3) In the above embodiments, the antenna 12 may be formed such that the antenna can be extended and contracted.

(4) Although the case 4 is configured to switch capacitive coupling with the passive element 14 by employing the folding, turning or sliding structure in the above embodiment, for example, by varying a distance between the extendable antenna 12 and the passive element 14, the case 4 may be configured to switch capacitive coupling or to adjust the degree of capacitive coupling.

(5) Although the passive element 14 is formed inside of the case unit 8 in the above embodiment, the passive element 14 may be disposed outside of the case unit 8. In this case, for the passive element 14, conductors may be disposed by printing conductors onto an outer face portion of the case unit 8 and the backside case unit 22, or by insert modeling of the case unit 8 and the backside case unit 22 made of insulating material.

(6) Although the antenna 12 is disposed in the case unit 6 and the passive element 14 is disposed in the case unit 8 in the above embodiments, the same effects can be obtained by disposing the passive element 14 in the case unit 6 and disposing the antenna 12 in the case unit 8.

While the illustrative and presently preferred embodiments of the present invention have been described in detail herein, it is to be understood that the inventive concepts may be otherwise variously embodied and employed and that the appended claims are intended to be construed to include such variations except insofar as limited by the prior art.

The entire disclosure of Japanese Patent Application No. 2004-357398 including specification, claims, drawings and summary are incorporated herein by reference in its entirety.

What is claimed is:

1. An antenna device comprising:

an antenna that is disposed in a first case unit;

a passive element that is disposed in a second case unit coupled to the first case unit, the passive element acquiring an antenna function due to capacitive coupling with the antenna; and a conductor that is disposed in the second case unit to suppress radiations from the passive element to one side of the second case unit.

2. The antenna device of claim 1, wherein the passive element is configured to pass electric current due to capacitive coupling with the antenna.

3. The antenna device of claim 1, wherein the passive element is configured to acquire capacitive coupling with the antenna by being approached by an end of the antenna.

4. The antenna device of claim 1, wherein the conductor is configured to act as a reflecting portion for radiations from the passive element.

5. The antenna device of claim 1, wherein the conductor is configured as a substrate disposed in the second case unit.

6. The antenna device of claim 1, wherein the passive element is disposed in the back side of the second case unit and the conductor is disposed in the front side of the second case unit.

7. The antenna device of claim 1, wherein capacitive coupling between the passive element and the antenna is switched depending on positions of the first case unit and the second case unit.

8. The antenna device of claim 1, wherein a distance between the passive element and an end of the antenna is varied in order for capacitive coupling between the passive element and the antenna to be switched, depending on positions thereof.

9. The antenna device of claim 1, wherein the passive element has a length of one half of a wavelength of the radiated electric wave, or a length approximate thereto.

10. A radio communication device having a first case unit and a second case unit, the radio communication device comprising:

an antenna that is disposed in the first case unit;

a passive element that is disposed in the second case unit coupled to the first case unit, the passive element acquiring an antenna function due to capacitive coupling with the antenna; and a conductor that is disposed in the second case unit in order to suppress radiations from the passive element to one side of the second case unit.

11. The radio communication device of claim 10, wherein the passive element is configured to pass electric current due to capacitive coupling with the antenna.

12. The radio communication device of claim 10, wherein the passive element is configured to acquire capacitive coupling with the antenna by being approached by an end of the antenna.

13. The radio communication device of claim 10, wherein the conductor is configured to act as a reflecting portion for radiations from the passive element.

14. The radio communication device of claim 10, wherein the conductor is configured as a substrate disposed in the second case unit.

15. The radio communication device of claim 10, wherein the passive element is disposed in the back side of the second case unit and the conductor is disposed in the front side of the second case unit.

16. The radio communication device of claim 10, wherein capacitive coupling between the passive element and the antenna is switched depending on positions of the first case unit and the second case unit.

17. The radio communication device of claim 10, wherein a distance between the passive element and an end of the antenna is varied in order for capacitive coupling between the passive element and the antenna to be switched, depending on positions thereof.

18. The radio communication device of claim 10, wherein the passive element has a length of one half of a wavelength of the radiated electric wave, or a length approximate thereto.

* * * * *